US007819666B2

(12) United States Patent
Sihler et al.

(10) Patent No.: US 7,819,666 B2
(45) Date of Patent: Oct. 26, 2010

(54) ROTATING ELECTRICAL CONNECTIONS AND METHODS OF USING THE SAME

(75) Inventors: Joachim Sihler, Cheltenham (GB); Hoe S. Ooi, Cirencester (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/323,844

(22) Filed: Nov. 26, 2008

(65) Prior Publication Data

US 2010/0130027 A1 May 27, 2010

(51) Int. Cl.
*H01R 39/00* (2006.01)

(52) U.S. Cl. ..... 439/26; 439/29

(58) Field of Classification Search ..... 439/26, 439/27, 20, 21, 22, 29
See application file for complete search history.

(56) References Cited

U.S. PATENT DOCUMENTS 1,070,307 A * 8/1913 Twining ..... 439/29
1,176,554 A * 3/1916 Herzig ..... 439/17
1,720,619 A * 7/1929 Baldwin ..... 439/27
2,070,211 A * 2/1937 Mehr ..... 439/29
2,919,420 A * 12/1959 Snodgrass et al. ..... 439/29
3,193,636 A * 7/1965 Daniels ..... 200/51.12
3,439,307 A * 4/1969 Ruscher ..... 439/21
3,808,577 A * 4/1974 Mathauser ..... 439/39
3,963,291 A * 6/1976 Maloof ..... 439/28
5,113,953 A 5/1992 Noble
5,265,682 A 11/1993 Russell et al.
5,409,403 A * 4/1995 Falossi et al. ..... 439/668
5,520,255 A 5/1996 Barr et al.
5,553,678 A 9/1996 Barr et al.
5,553,679 A 9/1996 Thorp et al.
5,582,259 A 12/1996 Barr et al.
5,603,385 A 2/1997 Colebrook et al.
5,673,763 A 10/1997 Thorp et al.
5,685,379 A 11/1997 Barr et al.
5,695,015 A 12/1997 Barr et al.
5,706,905 A 1/1998 Barr et al.
5,778,992 A 7/1998 Fuller et al.
5,803,185 A 9/1998 Barr et al.
5,899,753 A * 5/1999 Wong et al. ..... 439/17
5,971,085 A 10/1999 Colebrook et al.
6,089,332 A 7/2000 Barr et al.
6,092,610 A 7/2000 Kosmala et al.
6,158,529 A 12/2000 Dorel
6,244,361 B1 6/2001 Comeau et al.

(Continued)

OTHER PUBLICATIONS

Samuel, G. Robello, "Downhole Drilling Tools: Theory & Practice for Engineers & Students" 288-333 (2007).

(Continued)

*Primary Examiner*—Hae Moon Hyeon
(74) *Attorney, Agent, or Firm*—Vincent Loccisano; Jeremy Welch; Brigitte Echols

(57) ABSTRACT

This invention provides rotating electrical connections and methods of using the same. One aspect of the invention provides a rotating electrical connection. The rotating electrical connection includes: a rotary member and a pin. The rotary member includes a contact surface and is configured for rotation about a rotational axis. The rotational axis intersects with the contact surface. The pin is configured to contact the rotary member at the intersection of the rotational axis and the contact surface.

22 Claims, 5 Drawing Sheets

U.S. PATENT DOCUMENTS

| | | | | |
|---|---|---|---|---|
| 6,364,034 | B1 | 4/2002 | Schoeffler | |
| 6,394,193 | B1 | 5/2002 | Askew | |
| 6,464,405 | B2 * | 10/2002 | Cairns et al. | 385/56 |
| 7,377,825 | B2 * | 5/2008 | Bankstahl | 439/889 |
| 2001/0052428 | A1 | 12/2001 | Larronde et al. | |
| 2002/0011359 | A1 | 1/2002 | Webb et al. | |
| 2007/0154341 | A1 | 7/2007 | Saenger | |
| 2007/0251729 | A1 * | 11/2007 | Sand et al. | 175/107 |

OTHER PUBLICATIONS

"Standard Handbook of Petroleum & Natural Gas Engineering" 4-276-4-299 (William C. Lyons & Gary J. Plisga eds. 2006).

Gelfgat, Yakov A et al., 1 Advanced Drilling Solutions: Lessons from the FSU 154-72 (2003).

* cited by examiner

ROTATING ELECTRICAL CONNECTIONS AND METHODS OF USING THE SAME

FIELD OF THE INVENTION

The present invention relates to rotating electrical connections.

BACKGROUND OF THE INVENTION

Electrical generation is a persistent challenge in downhole drilling environments.

Transmission of power from the surface is often not practicable. Accordingly, mud motors are frequently used to generate downhole power. A mud motor is composed of a rotating member (a rotor) and a stationary member (a stator). Transmitting power between these two components or between the rotor and another device can be challenging.

Typically, slip rings or slip ring assemblies are used to maintain contact between a stationary and a rotating member. Slip rings consist of continuous rings that are attached to one member (stationary or rotating) where the axis of the ring coincides with the axis of rotation. Brushes or spring tabs are located on the other member so that during rotation, the brushes or spring tabs slide on the ring surface.

One of the shortcomings of the slip ring is that friction causes wear, which limits the life of the slip ring. Moreover, the slip ring assembly must be engineered to prevent separation between the slip ring and the brushes or spring tabs. Accordingly, there is a need for a more robust electrical connection.

SUMMARY OF THE INVENTION

This invention provides rotating electrical connections and methods of using the same.

One aspect of the invention provides a rotating electrical connection. The rotating electrical connection includes: a rotary member and a pin. The rotary member includes a contact surface and is configured for rotation about a rotational axis. The rotational axis intersects with the contact surface. The pin is configured to contact the rotary member at the intersection of the rotational axis and the contact surface.

This aspect can have several embodiments. The rotating electrical connection can include a first wire connected to the rotary member and a second wire connected to the pin. The rotating electrical connection can include a spring configured to hold the pin in contact with the contact surface of the rotary member. The rotating electrical connection can include a sleeve, wherein the pin and the spring are received within the sleeve. The sleeve can include an interior slot and the pin can include a tab configured to mate with the slot to prevent rotation of the pin. Alternatively, the pin can be configured for rotation.

The rotary member and the pin can be surrounded by fluid. The rotary member and the pin can be received in a drill string. The rotating electrical connection can include an insulator surrounding the rotary member. The portion of the pin that contacts the rotary member can be conically shaped. The contact surface of the rotary member can be substantially flat. The rotary member and the pin can each include a corresponding concentric arrangement of conductors and insulators. Contact between the rotary member and the pin can be a low friction contact. The rotary member and the pin can be wear-resistant.

Another aspect of the invention provides a rotating electrical connection. The rotating electrical connection includes a rotary member and a pin. The rotary member includes an interior conductor, a layer of insulation surrounding the interior conductor, an exterior conductor surrounding the layer of insulation, and a contact surface. The rotary member is configured for rotation about a rotational axis. The rotational axis intersects with the contact surface. The pin is configured to contact the rotary member at the intersection of the rotational axis with the contact surface. The pin includes an interior conductor, a layer of insulation surrounding the interior conductor, and an exterior conductor surrounding the layer of insulation.

This aspect can have several embodiments. The rotating electrical connection can include a spring configured to hold the pin in contact with the contact surface of the rotary member. The rotating electrical connection of claim can include a sleeve, wherein the pin and the spring are received within the sleeve. The sleeve can include an interior slot and the pin can includes a tab configured to mate with the slot to prevent rotation of the pin.

Another aspect of the invention provides a rotating electrical connection. The rotating electrical connection includes a rotary member and a pin. The rotary member includes a plurality of conductors, a plurality of insulators, and a contact surface. The rotary member can be configured for rotation about a rotational axis. The rotational axis can intersect with the contact surface. The conductors and insulators can be arranged in concentric annular layers. One of the plurality of the insulators can separate each of the conductors. The pin is configured to contact the rotary member at the intersection of the rotational axis with the contact surface. The pin includes a plurality of conductors, a plurality of insulators, and a contact surface. The rotary member can be configured for rotation about a rotational axis. The rotational axis can intersect with the contact surface. The conductors and insulators can be arranged in concentric annular layers. One of the plurality of the insulators can separate each of the conductors. The arrangement and thickness of the plurality of insulators and the plurality of conductors in the rotary member can substantially correspond to the arrangement and thickness of the plurality of insulators and the plurality of conductors in the pin.

This aspect can have several embodiments. The rotating electrical connection can include a spring configured to hold the pin in contact with the contact surface of the rotary member. The rotation electrical connection can include a sleeve, wherein the pin and the spring are received within the sleeve. The sleeve can include an interior slot and the pin can include a tab configured to mate with the slot to prevent rotation of the pin.

Another aspect of the invention provides a method of transmitting electrical current. The method includes providing a rotating electrical connection comprising a rotary member and a pin, rotating the rotary member, and passing electrical current through the rotating electrical connection. The rotary member includes a contact surface. The rotary member is configured for rotation about a rotational axis. The rotational axis intersects with the contact surface. The pin is configured to contact the rotary member at the intersection of the rotational axis and the contact surface.

DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views and wherein.

DETAILED DESCRIPTION OF THE INVENTION

This invention provides rotating electrical connections and methods of using the same. Some embodiments of the invention can be used in a wellsite system.

Wellsite System

Figure 1:
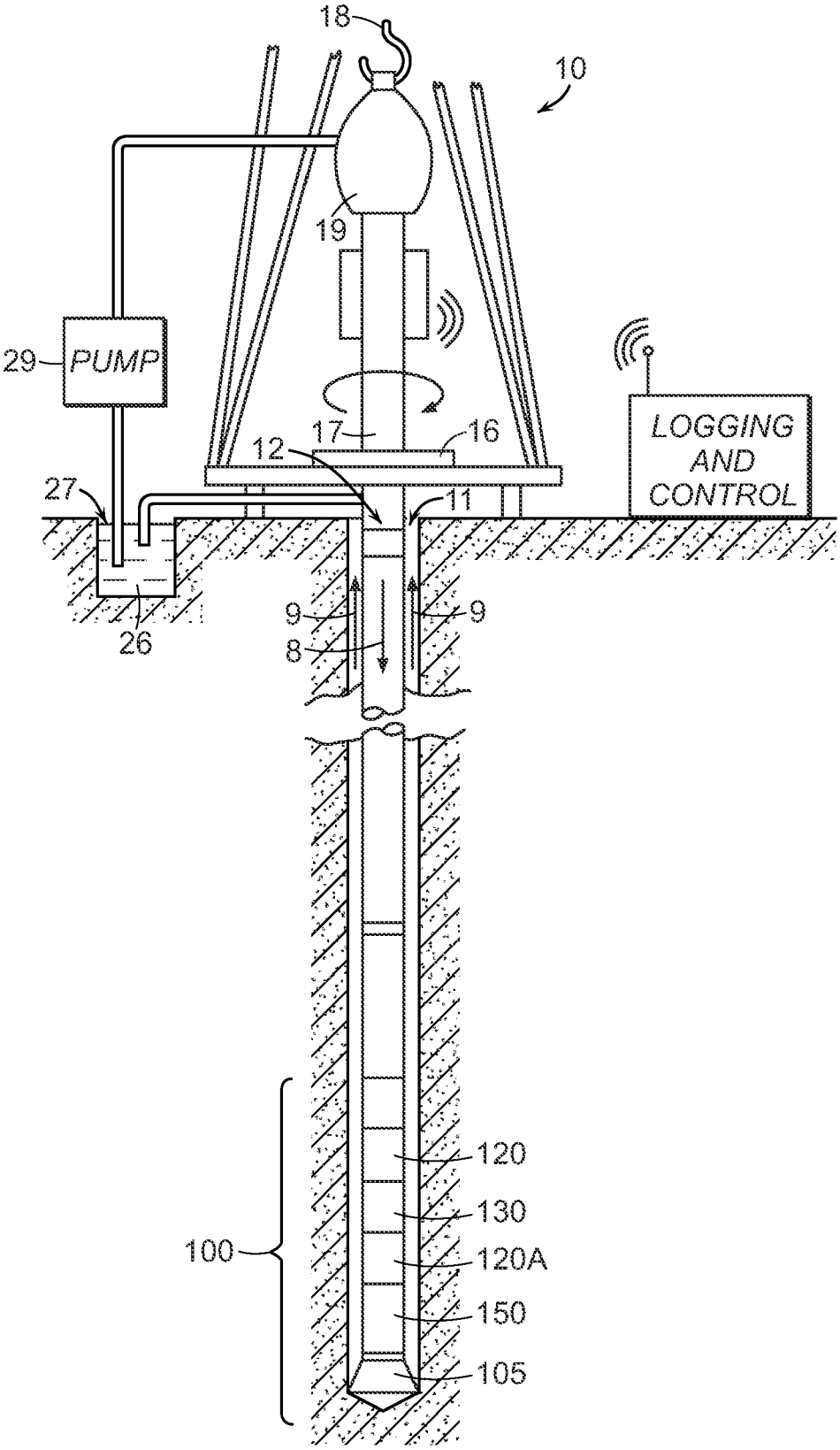
FIG. 1 illustrates a wellsite system in which the present invention can be employed.

FIG. 1 illustrates a wellsite system in which the present invention can be employed. The wellsite can be onshore or offshore. In this exemplary system, a borehole 11 is formed in subsurface formations by rotary drilling in a manner that is well known. Embodiments of the invention can also use directional drilling, as will be described hereinafter.

A drill string 12 is suspended within the borehole 11 and has a bottom hole assembly 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this well known manner, the drilling fluid lubricates the drill bit 105 and carries formation cuttings up to the surface as it is returned to the pit 27 for recirculation.

The bottom hole assembly 100 of the illustrated embodiment includes a logging-while-drilling (LWD) module 120, a measuring-while-drilling (MWD) module 130, a roto-steerable system and motor, and drill bit 105.

The LWD module 120 is housed in a special type of drill collar, as is known in the art, and can contain one or a plurality of known types of logging tools. It will also be understood that more than one LWD and/or MWD module can be employed, e.g. as represented at 120A. (References, throughout, to a module at the position of 120 can alternatively mean a module at the position of 120A as well.) The LWD module includes capabilities for measuring, processing, and storing information, as well as for communicating with the surface equipment. In the present embodiment, the LWD module includes a pressure measuring device.

The MWD module 130 is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator (also known as a "mud motor") powered by the flow of the drilling fluid, it being understood that other power and/or battery systems may be employed. In the present embodiment, the MWD module includes one or more of the following types of measuring devices: a weight-on-bit measuring device, a torque measuring device, a vibration measuring device, a shock measuring device, a stick slip measuring device, a direction measuring device, and an inclination measuring device.

A particularly advantageous use of the system hereof is in conjunction with controlled steering or "directional drilling." In this embodiment, a roto-steerable subsystem 150 (FIG. 1) is provided. Directional drilling is the intentional deviation of the wellbore from the path it would naturally take. In other words, directional drilling is the steering of the drill string so that it travels in a desired direction.

Directional drilling is, for example, advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well.

A directional drilling system may also be used in vertical drilling operation as well. Often the drill bit will veer off of an planned drilling trajectory because of the unpredictable nature of the formations being penetrated or the varying forces that the drill bit experiences. When such a deviation occurs, a directional drilling system may be used to put the drill bit back on course.

A known method of directional drilling includes the use of a rotary steerable system ("RSS"). In an RSS, the drill string is rotated from the surface, and downhole devices cause the drill bit to drill in the desired direction. Rotating the drill string greatly reduces the occurrences of the drill string getting hung up or stuck during drilling. Rotary steerable drilling systems for drilling deviated boreholes into the earth may be generally classified as either "point-the-bit" systems or "push-the-bit" systems.

In the point-the-bit system, the axis of rotation of the drill bit is deviated from the local axis of the bottom hole assembly in the general direction of the new hole. The hole is propagated in accordance with the customary three point geometry defined by upper and lower stabilizer touch points and the drill bit. The angle of deviation of the drill bit axis coupled with a finite distance between the drill bit and lower stabilizer results in the non-collinear condition required for a curve to be generated. There are many ways in which this may be achieved including a fixed bend at a point in the bottom hole assembly close to the lower stabilizer or a flexure of the drill bit drive shaft distributed between the upper and lower stabilizer. In its idealized form, the drill bit is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953.

In the push-the-bit rotary steerable system there is usually no specially identified mechanism to deviate the bit axis from the local bottom hole assembly axis; instead, the requisite non-collinear condition is achieved by causing either or both of the upper or lower stabilizers to apply an eccentric force or displacement in a direction that is preferentially orientated with respect to the direction of hole propagation. Again, there are many ways in which this may be achieved, including non-rotating (with respect to the hole) eccentric stabilizers (displacement based approaches) and eccentric actuators that apply force to the drill bit in the desired steering direction. Again, steering is achieved by creating non co-linearity between the drill bit and at least two other touch points. In its idealized form the drill bit is required to cut side ways in order to generate a curved hole. Examples of push-the-bit type rotary steerable systems, and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; and 5,971,085.

Figure 2:
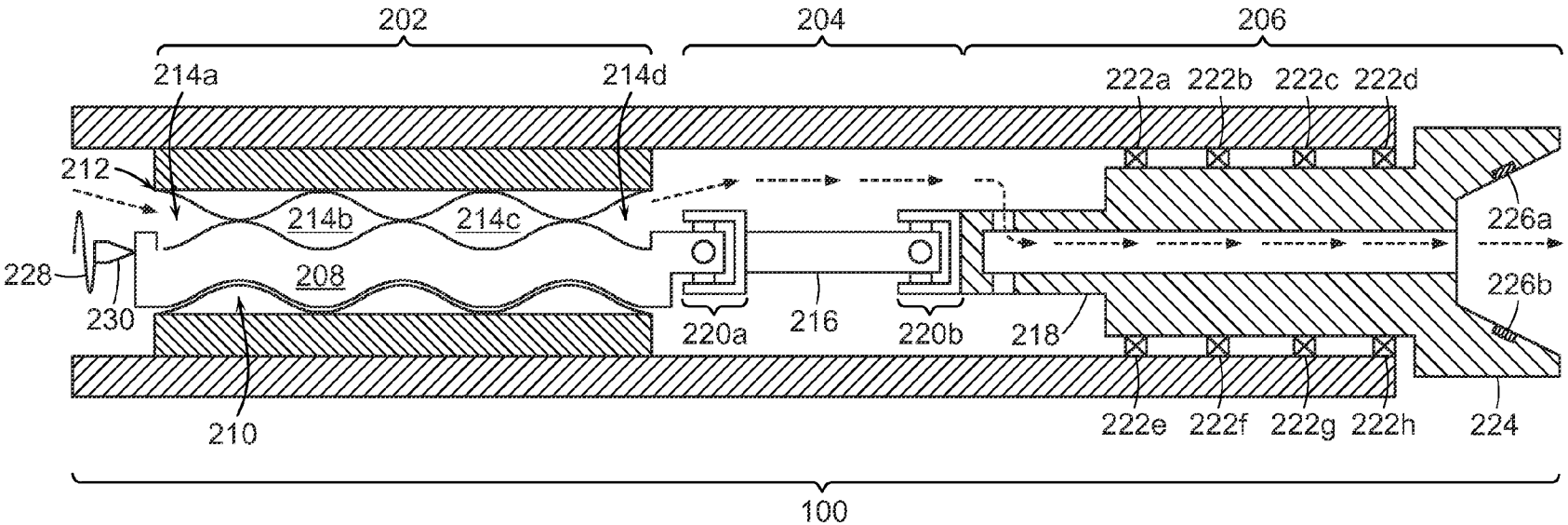
FIG. 2 illustrates a bottom hole assembly in which the present invention can be employed.

Referring to FIG. 2, a bottom hole assembly 100 is provided including a downhole motor 202, a shaft section 204, and a rotating drill bit section 206.

Downhole motor 202 can be any of a number of now known or later developed downhole motors (also known as "mud motors"). Such devices include turbine motors, positive displacement motors, Moineau-type positive displacement motors, and the like. A Moineau-type positive displacement motor is depicted in FIG. 2. Mud motors are described in a number of publications such as G. Robello Samuel, *Downhole Drilling Tools: Theory & Practice for Engineers & Students* 288-333 (2007); *Standard Handbook of Petroleum & Natural Gas Engineering* 4-276-4-299 (William C. Lyons & Gary J. Plisga eds. 2006); and 1 Yakov A. Gelfgat et al., *Advanced Drilling Solutions: Lessons from the FSU* 154-72 (2003).

Generally, a downhole motor 202 consists of a rotor 208 and a stator 210. During drilling, high pressure fluid is pumped through the drill string 12 into the top end 212 of the downhole motor 202 to fill first set of cavities 214*a*. The pressure differential across adjacent cavities 214*a* and 214*b* forces rotor 208 to turn. As this happens, adjacent cavities are opened allowing fluid to progress through the downhole motor 202.

The rotor 208 is connected to a shaft 216 to transmit the power generated by rotation of the rotor 208. The rotor 208 and rotating drill bit shaft 218 can be connected to shaft 216 to by universal joints 220*a* and 220*b* to allow for flexibility. Rotating drill bit shaft 218 is supported within drill bottom hole assembly 100 by bearings 222*a-h*. Shaft 216 rotates drill bit shaft 218, which is connected to drill bit 224.

Fluid flows through downhole motor 202, around shaft 216, into drill string shaft 218, and out of the drill string shaft 218 adjacent to drill bit 224 to lubricate drill bit 224 during drilling.

Drill bit 224 includes one or more sensors 226*a*, 226*b* to measure drilling performance and/or drill bit location. Sensors 226*a*, 226*b* can include one more devices such as a three-axis accelerometer and/or magnetometer sensors to detect the inclination and azimuth of the drill bit 224. Sensors 226*a*, 226*b* can also provide formation characteristics or drilling dynamics data. Formation characteristics can include information about adjacent geologic formation gathered from ultrasound or nuclear imaging devices such as those discussed in U.S. Patent Publication No. 2007/0154341, the contents of which is hereby incorporated by reference herein. Drilling dynamics data can include measurements of the vibration, acceleration, velocity, and temperature of the bottom hole assembly 100 and/or drill bit 224.

One or more wires 228 are provided transmitting data and/or power from to and from an uphole system (not depicted). These wires 228 can connect to sensors positioned near the top end of 212 of downhole motor 202. However, such sensors have limited utility as distance between the top end 212 of downhole motor 202 and the drill bit 224 can be between about 40 feet and about 60 feet.

Passing wires through the downhole motor 202, shaft section 204, and drill bit section 206 is often not practicable because of the numerous moving parts. Moreover, a typical rotor 208 is about 20 feet long and cannot be bored. Finally, the wires 228 cannot simply be connected to the rotor 208 as the rotor 208 spins at a different speed than the wires 228 and would eventually tangle and/or shear the wires 228.

Accordingly, there is a need for a device (illustrated as element 230 for connecting one or more wires 228 with a rotating element, such as rotor 208.

Rotating Electrical Connections

Figure 3A:
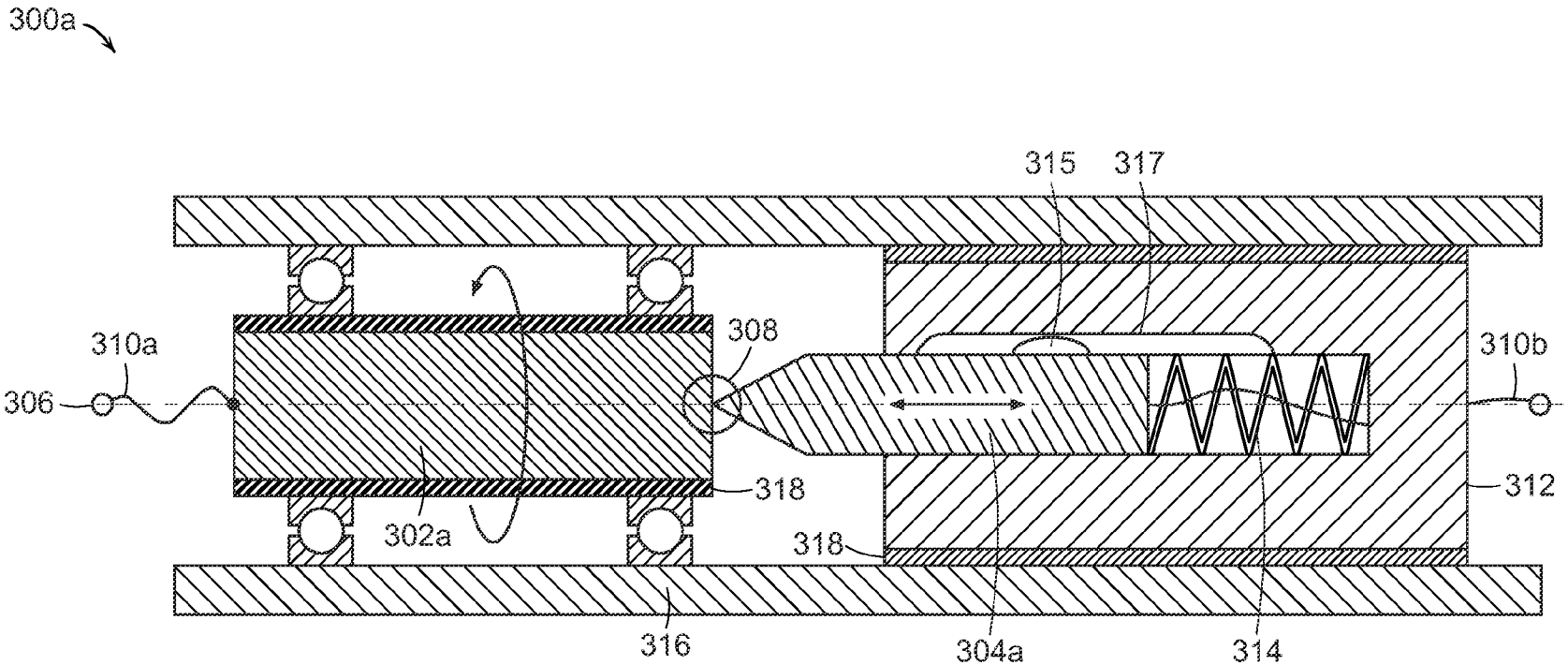
FIGS. 3A and 3B illustrate a rotating electrical connection.

Referring to FIG. 3A, a rotating electrical connection 300*a* is provided. The connection includes a rotating member 302*a* and a pin 304*a*. The rotary member 302*a* rotates about a rotational axis 306 (illustrated by the dashed line) and has a contact surface 308. The pin 304*a* is configured to contact the rotary member 302*a* at the intersection of the rotational axis and the contact surface.

The rotating electrial connection 300*a* can be used to transmit electrical current and/or data encoded in electrical data.

In some embodiments, the pin 304*a* has a conical or angular shaped tip as depicted in FIG. 3A. Such an embodiment advantageously minimizes contact with rotating member 302*a*, and thereby reduces friction and wear. Moreover, an angled tip will exhibit the lowest rotational velocity. However, the invention is not limited to angular tips. Rather, the tip can be rounded, or may be perpendicular to rotational axis 306.

The contact surface 308 is substantially flat in some embodiment. In other embodiments, the contact surface 308 is curved or angled. The contact surface 308 can be designed specifically to mate with pin 304*a*.

The rotating member 302*a* and pin 304*a* can be connected to wires 310*a* and 310*b*.

The pin 304*a* can be received in a sleeve 312 to allow for a controlled amount of movement. A spring 314 or compression means can be received within the sleeve 312 to hold the pin 304*a* against the contact surface 308 and to absorb forces applied to the pin 304*a*. Such compression means can include a hydraulic or pneumatic chamber or a hydraulic or pneumatic bladder. Other compression means can incorporate magnetic forces to urge the pin 304*a* toward the contact surface 308.

The pin 304*a* can include a tab 315 configured to mate with a slot 317 in the sleeve 312 to prevent the pin 304*a* from rotating. Alternatively, the pin 304*a* can be allowed to rotate, with power transmitted to sleeve 312 by contact between the pin and sleeve and/or through spring 314.

The rotary member 302*a* and the pin 304*a* can, in some embodiments, be composed of a conductive material such as metal (e.g. copper, gold, silver, nickel, iron, and alloys thereof), graphite, or conductive resins. Conductive resins are available, for example, from Cool Polymers of Warwick, R.I.

The rotary member 302*a* and the pin 304*a* can be coated or comprised of a wear resistant material such as "high speed steel" or carbon steel. High speed steels are Fe—C—X multi-component alloys where X represents chromium, tungsten, molybdenum, vanadium, and/or cobalt. Generally the X component is present in excess of 7%, along with more than 0.60% carbon. Carbon steel is steel in which the main alloying constituent is carbon.

The rotary member 302*a* and the pin 304*a* can be surrounded by an insulating layer 318. Suitable insulators include, but are not limited to polytetrafluoroethylene (PTFE), thermoplastic polymers, polymer compounds, resins, silicon dioxide, glass, porcelain, ceramics, polyethylene, cross-linked polyethylene, ethylene-propylene rubber, silicone rubber, polyvinyl chloride (PVC), paper, oil impregnated paper, ethylene tetrafluoroethylene (ETFE), and ethylene propylene diene monomer (EPDM) rubber.

The rotary member 302*a* and the pin 304*a* can be encased in fluid. In some embodiments, the rotary member 302*a* and the pin 304*a* are encased in a lubricant to reduce friction, transmit heat, and protect the connection from corrosion. Suitable lubricants include oils such as mineral oils and synthetic oils and greases such as silicone grease, fluoroether-based grease, and lithium-based grease. Alternatively, the rotary member and the pin can be encased in a gas, for example an inert gas (e.g. nitrogen, helium, neon, argon, krypton, xenon, and/or radon).

In some embodiments, the rotary member 302*a* and the pin 304*a* are not encased in a fluid or gas, but rather are open to the downhole drilling environment. In such an embodiment, the rotary member 302*a* and the pin 304*a* may be in contact with a drilling fluid such as mud.

The rotary electrical connection 300 can be received in many embodiments. For example, the connection 300*a* can be received in a cylinder 316. The cylinder 316 can be a drill string. Alternatively, the cylinder 316 can be a mud motor. In such an embodiment, the rotating member 302 can be the rotor, while the cylinder 316 is the stator.

The rotating electrical connector 300*a* can include one or more electronic devices to remove any noise introduced into the current and/or data. Such a device can be a Fast Fourier Transform (FFT) device as known by those of skill in the art.

Figure 3B:
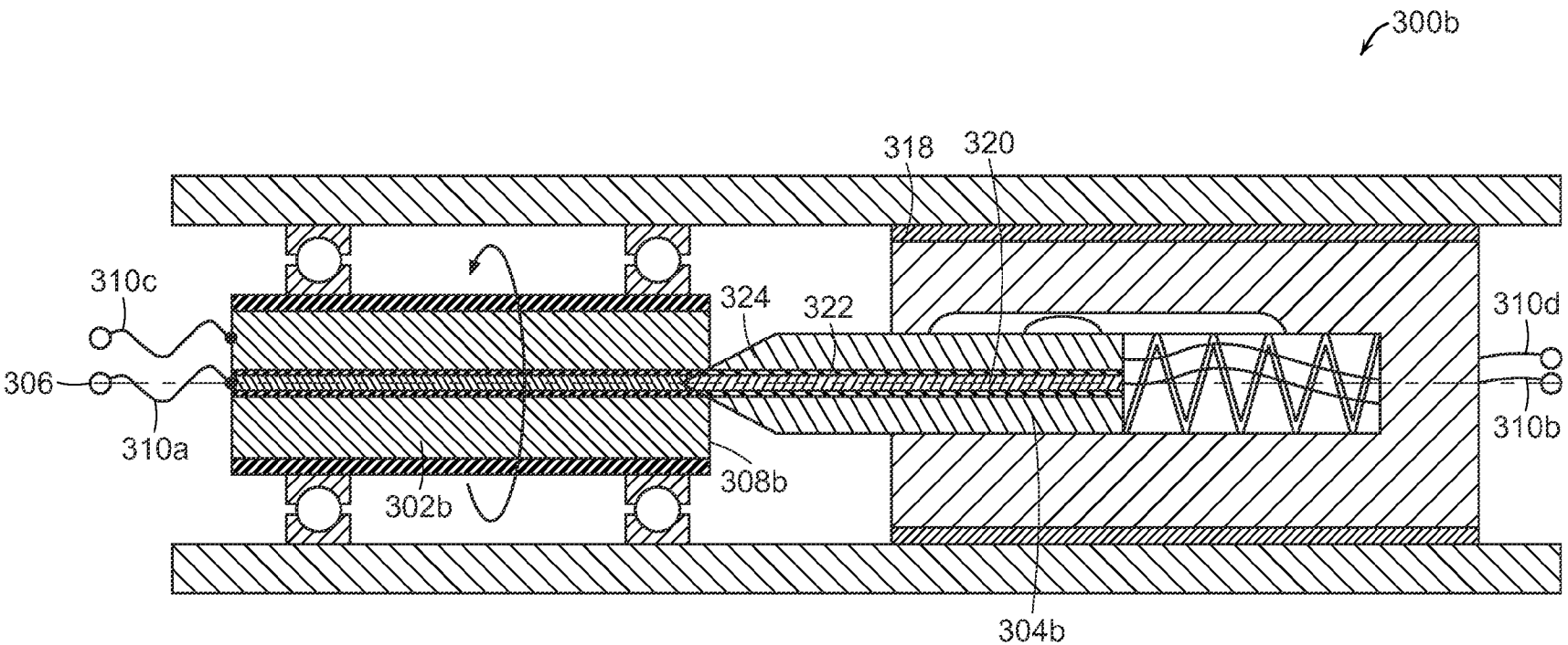

Referring to FIG. 3B, a multi-channel rotating electrical connector 300*b* is provided. Rotating member 302*b* and pin 304*b* contain an interior conductor 320, surrounded by a layer of insulation 322, and an exterior conductor 324. Such an arrangement allows for the simultaneous transmission of two or more channels of electrical current and/or data. Additional wires 310*c* and 310*d* are provided to transmit electricity to and from the connector 300*b*.

The principles illustrated in FIG. 3B are not limited to a two-channel embodiment. Rather, a multi-channel rotating connect can be fabricated by combining multiple concentric conductors and insulation layers.

In some embodiments, the rotating member 302*b* and pin 304 are configured such that the thickness and arrangement of the interior conductor 320, and insulation layer 322, and exterior conductor 324 are identical or substantially identical.

In some embodiments, the contact surface 308*b* is configured to prevent the pin 304 from deviating from the rotational axis 306. For example, the contact surface can include an angled depression that mirrors the angled geometry of the tip of pin 304.

The rotating electrical connectors 300*a*, 300*b* can be engineered to carry a variety of voltages and amperages. For example, the current carried across rotating electrical connectors can by about 4-8 amps. The materials and gauges selected for rotating electrical connections 300*a*, 300*b*, wires 310*a*, 310*b*, 310*c*, 310*d*, and other components can be adjusted to handle increased electrical loads as will be appreciated by one of skill in the art. Appropriate wire gauges can be determined either by calculation or by reference to standards such as the American wire gauge (also known as the Brown & Sharpe wire gauge) and the National Electrical Code (NEC).

Figure 4:
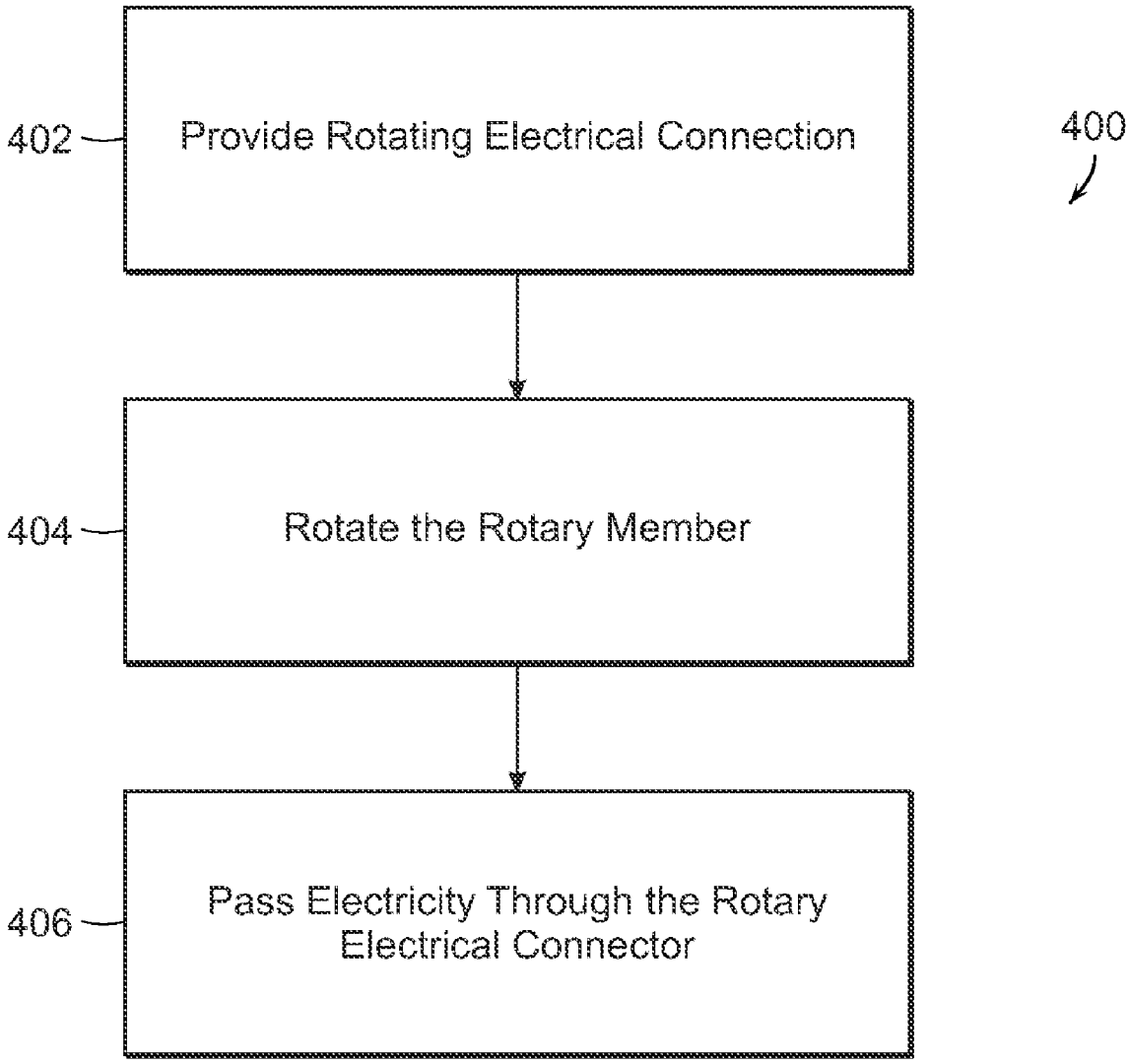
FIG. 4 illustrates a method of using a rotating electrical connection.

Referring to FIG. 4, a method 400 of utilizing a rotating electrical connector is provided. In step 402, a rotating electrical connection is provided. In step 404, the rotary member is rotated. In step 406, electricity is passed through rotating electrical connection.

Incorporation by Reference

All patents, published patent applications, and other references disclosed herein are hereby expressly incorporated by reference in their entireties by reference.

Equivalents

Those skilled in the art will recognize, or be able to ascertain using no more than routine experimentation, many equivalents of the specific embodiments of the invention described herein. Such equivalents are intended to be encompassed by the following claims.

Specifically, although described in the context of a downhole drilling environment, the invention provided herein is equally applicable to other embodiments. For example, the invention can be incorporated into conventional AC or DC motors. Likewise, a rotating electrical connector can be incorporated in an extension cord reel.

The invention claimed is:

1. A rotating electrical connection comprising:

a rotary member having a contact surface, the rotary member configured for rotation about a rotational axis, the rotational axis intersecting with the contact surface; and a pin configured to contact the rotary member at the intersection of the rotational axis and the contact surface;

wherein the rotary member and the pin are encased in an inert gas within a surrounding wall; and a spring configured to hold the pin in contact with the contact surface of the rotary member.

2. The rotating electrical connection of claim 1, further comprising:

a sleeve including an interior slot;

wherein the pin and the spring are received within the sleeve; and wherein the pin includes a tab configured to mate with the slot to prevent rotation of the pin.

3. The rotating electrical connection of claim 1, wherein the pin is configured for rotation.

4. The rotating electrical connection of claim 1, wherein the rotary member and the pin are received in a drill string.

5. The rotating electrical connection of claim 1, further comprising:

an insulator surrounding the rotary member.

6. The rotating electrical connection of claim 1, wherein the portion of the pin that contacts the rotary member is conically shaped.

7. The rotating electrical connection of claim 1, wherein the contact surface of the rotary member is substantially flat.

8. The rotating electrical connection of claim 1, wherein the rotary member and the pin each include a corresponding concentric arrangement of conductors and insulators.

9. The rotating electrical connection of claim 1, wherein contact between the rotary member and the pin is a low friction contact.

10. The rotating electrical connection of claim 1, wherein the rotary member and the pin are wear-resistant.

11. The rotating electrical connection of claim 1, wherein the inert gas is one or more selected from the group consisting of:

nitrogen, helium, neon, argon, krypton, xenon, and radon.

12. A rotating electrical connection comprising:

a rotary member comprising:

an interior conductor;

a layer of insulation surrounding the interior conductor;

an exterior conductor surrounding the layer of insulation; and a contact surface spanning across the interior conductor, the layer of insulation, and the exterior conductor;

wherein the rotary member is configured for rotation about a rotational axis, the rotational axis intersecting with the contact surface; and a pin configured to contact the rotary member at the intersection of the rotational axis with the contact surface, the pin comprising:

an interior conductor;

a layer of insulation surrounding the interior conductor; and an exterior conductor surrounding the layer of insulation;

wherein the arrangement and thickness of the insulation and the conductors in the rotary member substantially corresponds to the arrangement and thickness of the insulation and the conductors in the pin.

13. The rotating electrical connection of claim 12, further comprising:

a spring configured to hold the pin in contact with the contact surface of the rotary member.

14. The rotating electrical connection of claim 12, further comprising:

a sleeve including an interior slot;

wherein the pin and the spring are received within the sleeve; and wherein the pin includes a tab configured to mate with the slot to prevent rotation of the pin.

15. The rotating electrical connection of claim 12, wherein the rotary member and the pin are encased in an inert gas within a cylinder.

16. The rotating electrical connection of claim 15, wherein the inert gas is one or more selected from the group consisting of: nitrogen, helium, neon, argon, krypton, xenon, and radon.

17. A rotating electrical connection comprising:

a rotary member comprising:

a plurality of conductors;

a plurality of insulators; and a contact surface spanning across the interior conductor, the layer of insulation, and the exterior conductor;

wherein the rotary member is configured for rotation about a rotational axis, the rotational axis intersecting with the contact surface;

wherein the conductors and insulators are arranged in concentric annular layers; and wherein one of the plurality of the insulators separates each of the conductors; and a pin configured to contact the rotary member at the intersection of the rotational axis with the contact surface, the pin comprising:

a plurality of conductors;

a plurality of insulators; and a contact surface;

wherein the rotary member is configured for rotation about a rotational axis, the rotational axis intersecting with the contact surface;

wherein the conductors and insulators are arranged in concentric annular layers; and wherein one of the plurality of the insulators separates each of the conductors;

wherein the arrangement and thickness of the plurality of insulators and the plurality of conductors in the rotary member substantially corresponds to the arrangement and thickness of the plurality of insulators and the plurality of conductors in the pin.

18. The rotating electrical connection of claim 17, further comprising:

a spring configured to hold the pin in contact with the contact surface of the rotary member.

19. The rotating electrical connection of claim 17, further comprising:

a sleeve including an interior slot;

wherein the pin and the spring are received within the sleeve; and wherein the pin includes a tab configured to mate with the slot to prevent rotation of the pin.

20. The rotating electrical connection of claim 17, wherein the rotary member and the pin are encased in an inert gas within a cylinder.

21. The rotating electrical connection of claim 20, wherein the inert gas is one or more selected from the group consisting of: nitrogen, helium, neon, argon, krypton, xenon, and radon.

22. A method of transmitting electrical current, the method comprising:

providing a rotating electrical connection comprising:

a rotary member having:

an interior conductor;

a layer of insulation surrounding the interior conductor;

an exterior conductor surrounding the layer of insulation; and a contact surface spanning across the interior conductor, the layer of insulation, and the exterior conductor;

wherein the rotary member configured for rotation about a rotational axis, the rotational axis intersecting with the contact surface; and a pin configured to contact the rotary member at the intersection of the rotational axis and the contact surface, the pin comprising:

an interior conductor;

a layer of insulation surrounding the interior conductor; and an exterior conductor surrounding the layer of insulation, wherein the arrangement and thickness of the plurality of insulators and the plurality of conductors in the rotary member substantially corresponds to the arrangement and thickness of the plurality of insulators and the plurality of conductors in the pin;

rotating the rotary member; and passing electrical current through the rotating electrical connection.

* * * * *